United States Patent [19]

Gräbener et al.

[11] Patent Number: 4,890,998

[45] Date of Patent: Jan. 2, 1990

[54] PRESS FOR MANUFACTURE OF DIMENSIONALLY STABLE ARTICLES FROM POWDERED MATERIAL

[75] Inventors: Thomas Gräbener, Siegen; Theodor Gräbener, Netphen, both of Fed. Rep. of Germany

[73] Assignee: Theodor Grabener Pressensysteme GmbH & Co. KG, Wertenbach, Fed. Rep. of Germany

[21] Appl. No.: 238,927

[22] Filed: Aug. 31, 1988

[30] Foreign Application Priority Data

Sep. 2, 1987 [EP] European Pat. Off. ..... 87112788.2

[51] Int. Cl.[4] ..... B29C 43/04; B30B 11/02

[52] U.S. Cl. ..... 425/193; 100/280; 425/352; 425/411; 425/450.1

[58] Field of Search ..... 72/407, 453.04, 453.06, 72/453.08; 425/78, 416, 352, 450.1, 193, 451.2, 78; 100/280

[56] References Cited

U.S. PATENT DOCUMENTS

| | | | |
|---|---|---|---|
| 3,587,136 | 6/1971 | Hermes | 425/78 |
| 3,802,818 | 4/1974 | Watanabe et al. | 425/78 |
| 4,105,385 | 8/1978 | Hehl | 425/450.1 |
| 4,153,399 | 5/1979 | Dejantis | 425/78 |
| 4,260,346 | 4/1981 | Anderson | 425/78 |
| 4,380,427 | 4/1983 | Hehl | 425/451.2 |
| 4,482,307 | 11/1984 | Shaidl et al. | 425/78 |
| 4,565,116 | 1/1986 | Hehl | 425/451.2 |
| 4,636,167 | 1/1987 | Shibata | 425/450.1 |

FOREIGN PATENT DOCUMENTS

| | | |
|---|---|---|
| 224096 | 6/1987 | European Pat. Off. . |
| 164835 | 8/1900 | Fed. Rep. of Germany . |
| 254376 | 7/1910 | Fed. Rep. of Germany . |
| 1088811 | 9/1960 | Fed. Rep. of Germany . |

*Primary Examiner*—Willard Hoag

*Attorney, Agent, or Firm*—Fitch, Even, Tabin & Flannery

[57] ABSTRACT

A press for producing dimensionally stable moldings from powdered materials is described whereby a press frame and a press platen are provided in a press body and are linked together in movement by means of a drive and form a main press plunger. A hydraulic press part with at least two additional press axes is mounted in front of the main press plunger between the press frame and press platen. The second hydraulic press axis of hydraulic press part is actuated and controlled by its first axis through a hydraulic coupling device that has a variable transmission ratio, while the first axis of the hydraulic press part is in turn actuated by the press frame of the main press plunger. The movement ratios of the second press axis of the hydraulic press part can then be varied relative to the main press axis.

8 Claims, 2 Drawing Sheets

PRESS FOR MANUFACTURE OF DIMENSIONALLY STABLE ARTICLES FROM POWDERED MATERIAL

This invention concerns a press especially for producing dimensionally stable moldings from powdered materials, but also suitable for other applications, e.g., plastic compression molding and punching.

This invention is based on a press with a press body, a press frame, and a press platen as the main axis and guiding axis, linked together in movement by a drive and forming a main press plunger. These may be presses with a mechanical drive such as a toggle joint drive, but use of hydraulic presses is also possible.

Automatic hydraulic presses that can also be used in the production of complex moldings, e.g., moldings with one or more gradations in shape, are also known for production of dimensionally stable moldings from powdered materials (see, for example, German Patent (OLS) No. 3,142,126). In such cases, the actual die works with a press axis which has a separate hydraulic drive for each step to be formed on the molding, each requiring another working path relative to the die between its filling position and its pressing position.

Between the individual hydraulic drives of these known automatic hydraulic presses, there is necessarily a relatively complex movement sequence determined essentially by the shape of the molding to be produced, such movement being effected and monitored for the most part only through the use of complex electronic control systems.

Nevertheless, with the known automatic hydraulic presses, it is not assured that the movements of the various hydraulic drives required during each individual pressing operation will actually be carried out in exact coordination. Specifically, there is no assurance that the supply of hydraulic fluid to the individual hydraulic drives is always maintained exactly uniform with regard to quantity and rate, because there are often superimposed pressures. This then results in unpredictable superimposed movements of the hydraulic drives that cannot be fully regulated even by electronic path control, and can have a negative effect on the working results on the moldings.

Moreover, with the known automatic hydraulic presses, it is also a disadvantage that all hydraulic drives must execute relatively long strokes, which increases the cycle time with negative effect on productivity. Such high oil columns also result in large compression paths accompanied by a critical rebound effect.

In recognition of these disadvantages, a press has already been developed (see European Patent Application No. 87106634.6) which not only assures satisfactory and reproducible operation at all times of all press axes that interact, but can also be operated with a relatively high number of strokes. In addition, it has a high dimensional rigidity of the entire press system with a permanently high functional reliability.

With this type of press, a press frame and a press platen are provided as main axis and guiding axis in a press body and are linked together in movement by a mechanical drive, mainly a toggle joint drive, and together form a main press plunger. In front of the main press plunger between the press body and press platen, there is a hydraulic press part with at least one additional press axis, but preferably several additional press axes. The working movement of each press axis of the hydraulic press part is controlled and regulated as a function of path and time by the working movement of the main axis and guiding axis of the mechanical press part consisting of the press frame and the press platen.

The advantage of such a press system is that it can be implemented using a mechanical press that is already available, especially a toggle joint press, merely by integration of an additional hydraulic press part.

The goal of the present invention is to create a press of the type defined initially, namely including the design described directly above, that can be set up with no problem and without time-consuming remodeling work for various machining jobs. In particular, it is important to be able to vary the movements of the main press plunger and press die — at least temporarily — within given limits.

The stated goal according to this invention is achieved by a hydraulic press with at least two auxiliary press axes between the press frame and press platen in front of the main press plunger, and a hydraulic coupling system between the main drive and the auxiliary press axis which has a variable transmission ratio enabling the auxiliary axes to be actuated and controlled by the main drive.

With such a design of a press, the auxiliary hydraulic press part can be designed as an adapter and can be installed in an existing press irrespective of whether the existing press is a hydraulic press or one with a mechanical drive. However, it has proven to be especially expedient for the existing press to have a mechanical drive, especially a toggle joint drive.

In the type of operation of the auxiliary hydraulic press part according to this invention, its first press axis is used only to control the movement of the second press axis as an incident to the interaction of the first press axis with the moving press frame of the main press plunger.

Another important feature of this invention is that the transmission ratio of the coupling device can be varied between 1:1 and 1:0.25, preferably in uniform increments. It has proven successful for the transmission ratio to be adjustable to 1:0.75 and 1:0.5.

The coupling system according to this invention may consist of two piston-cylinder systems that can be linked together by means of hydraulic lines, where the first or primary piston-cylinder system includes several (e.g., four) identical piston-cylinder units, while any other or secondary piston-cylinder system has one piston-cylinder unit. The displacement volume of all piston-cylinder units of the first or primary piston-cylinder system should be at least equal to the displacement volume in one of the piston-cylinder units of the second or secondary piston-cylinder systems, in which case each individual piston-cylinder unit of the second or secondary piston-cylinder system can be operated as an independent press axis and each individual piston-cylinder unit can be controlled absolutely by itself, and several of them together can be controlled simultaneously to a limited extent.

For the proper interaction of the auxiliary hydraulic press part with the press, abutment supports are provided on the press frame for the pistons of the piston-cylinder units of the first or primary piston-cylinder system. The basic position of the abutment supports on the press frame relative to the first piston of the primary piston-cylinder system can be variable so any required variations in the press operation can be performed easily and simply. To this end each abutment support has an adjusting stop for the piston of the respective piston-cylinder unit which can in turn consist of a wedge adjustment that can be operated by a variable displacement motor.

An important feature of the press according to this invention is also the fact that the piston of at least a secondary piston-cylinder system can be acted on by the hydraulic coupling device against a constant given or supporting pressure. This standard or supporting pressure, which serves to raise the die, may preferably be between 20 and 25 bar.

The downward movement of the die required after conclusion of each pressing operation to release the workpiece, i.e., away from the bottom dead center of the press, or the ejection movement of the lower plunger upward, can be effected purely mechanically, i.e., by means of a cam mounted in the press with a rotary drive.

Finally, one feature of this invention consists of the fact that the die or the lower plunger with the counter-press can be controlled directly ($M_1$ press axis) by means of the first or primary piston-cylinder system, the die can be controlled in the retraction process by way of the primary piston-cylinder system and a first secondary piston-cylinder system, the movement of the lower plunger can be controlled by the primary piston-cylinder system in combination with a second secondary piston-cylinder system ($M_3$ press axis), and the movement of the upper plunger can be controlled by the primary piston-cylinder system in combination with a third secondary piston-cylinder system ($M_4$ press axis).

The object of this invention is illustrated in the figures which show the following.

Figure 1:
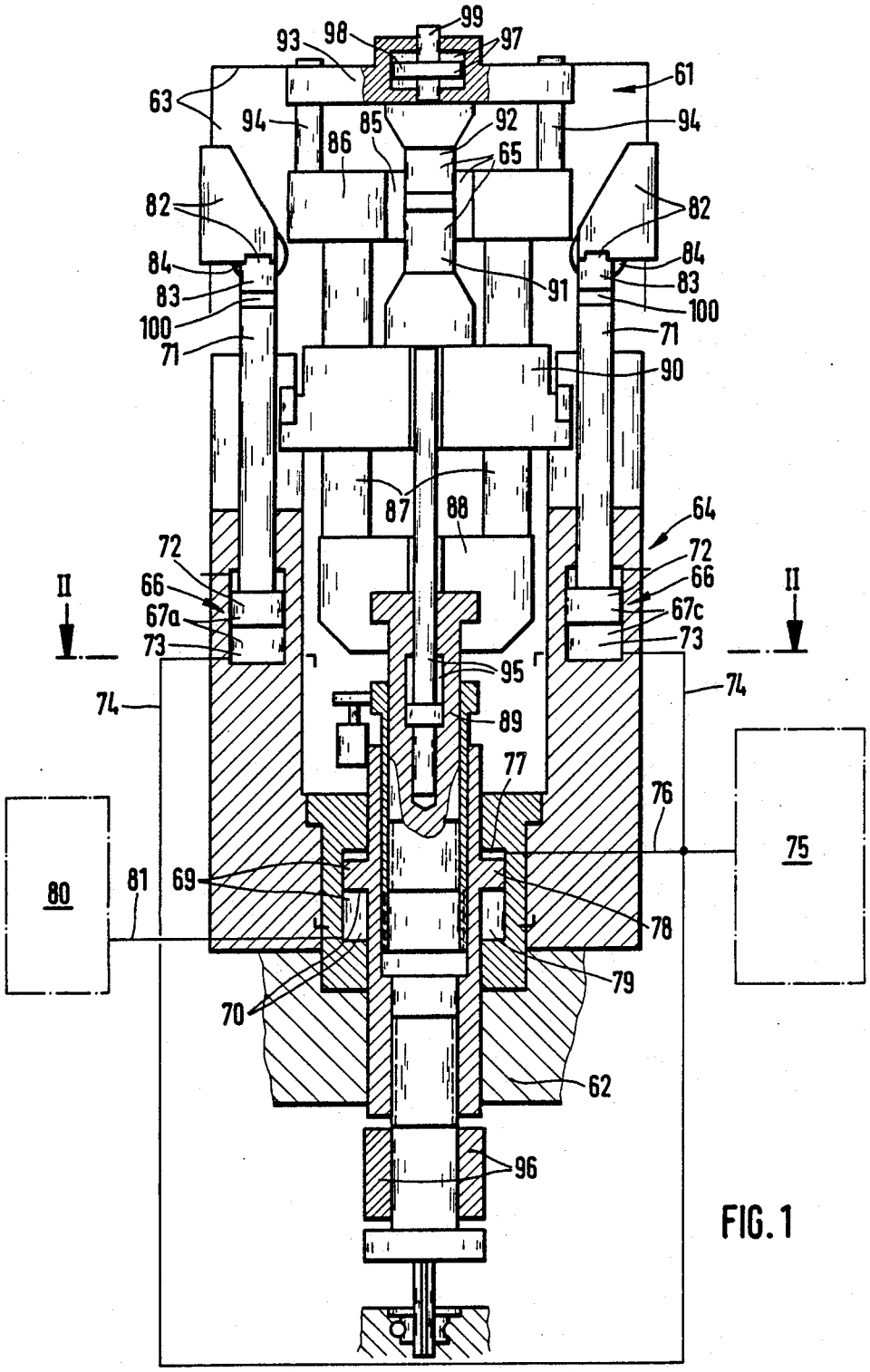
FIG. 1 shows a purely schematic diagram of the overall design of a press.

The figure shows as a practical example a hydromechanical press system 61 whose mechanical press part may advantageously take the form of a toggle press. For the sake of simplicity, only a part of the press platen 62 and a part of the press frame 63 of this toggle press are shown here. Press platen 62 is carried in a stationary mount by a press body, and can be raised and lowered relative to press frame 63.

Instead of the mechanical press part, a hydraulic press may also be used, which, of course, would likewise have a stationary press platen 62 and a press frame 63 that can be raised and lowered relative to it.

In either case, a hydraulic press part 64 is mounted between the stationary press platen 62 and the press frame 63. It can be raised and lowered, and carries the actual press die 65 near its upper end (FIG. 1).

The main press plunger of the hydromechanical press system 61 is formed by the interaction of press platen 62 and press frame 63, and is operative for the entire hydromechanical press system 61 as a so-called main and leading axis — the so-called X axis.

Hydraulic press part 64 of the hydromechanical press system 61 also forms at least one other press axis, but preferably several other press axes within hydromechanical press system 61.

With the hydromechanical press system 61 according to FIG. 1 of the drawings, the hydraulic press part 64 may be designed in such a way that it includes one or more additional press axes, so-called M press axes.

In the example according to FIG. 1, four different M press axes are provided and are designated as the $M_1$ press axis, the $M_2$ press axis, the $M_3$ press axis, and the $M_4$ press axis to differentiate them conveniently.

According to FIG. 1, the $M_1$ press axis acts directly on die 85 of press die 65 and is formed by a piston-cylinder system 66. This piston-cylinder system 66 includes several (e.g., four) piston-cylinder units **67*a*, 67*b*, 67*c*, 67*d*, each of which is positioned in the corner zones of the housing or frame 68 of hydraulic press part (64**) as shown especially in FIG. 2.

Figure 2:
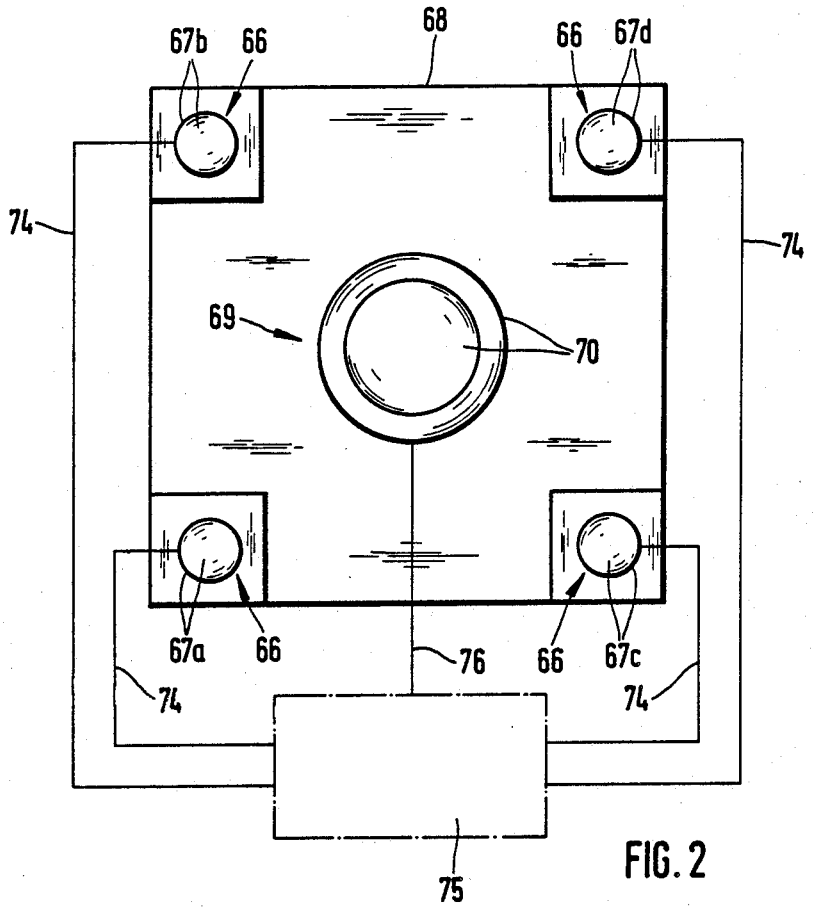
FIG. 2 shows a section along line II—II in FIG. 1 in a schematically simplified diagram.

The $M_2$ press axis is formed by a piston-cylinder system 69 that includes a piston-cylinder unit 70. This piston-cylinder unit 70 is built into the housing or frame 68 of hydraulic press part 64 in alignment with the longitudinal axis of the hydraulic press part. Essentially, it is intended for controlling die 85 of press die 65 in the press retraction movement as shown in FIG. 1 and 2. Similar piston-cylinder units 95 and 97 may also be used for additional control of the movement of the lower plunger and upper plunger of press die 65 (as $M_3$ and $M_4$ press axes).

Although piston plunger 71 of the pistons 72 provided in the individual piston-cylinder units **67*a*, 67*b*, 67*c*, and 67*d* project upward out of the housing or frame 68 with their free ends, a hydraulic supply line 74 is connected to each lower cylinder space 73 of these piston-cylinder units 67*a*, 67*b*, 67*c*, and 67*d*. By a controlling device 75 and a connecting line 76 provided for it, the hydraulic supply lines 74 may optionally be connected to the upper cylinder space 77 of piston-cylinder unit 70 of piston-cylinder system 69 (the $M_2$ press axis) in such a way that one, two, three, or four hydraulic lines 74 are opened through controlling device 75 to the connecting line 76. Then a corresponding flow connection is established between the open cylinder space 77 of the piston-cylinder system 69 or the piston-cylinder unit 70, as well as the lower cylinder spaces 73 of piston-cylinder system 66 or its piston-cylinder units 67*a*, 67*b*, 67*c* and 67*d***.

It is important to point out here that the combined displacement volume of all piston-cylinder units **67*a*, 67*b*, 67*c*, and 67*d* of the piston-cylinder system 66 is identical to the displacement volume of the piston-cylinder unit 70 of piston-cylinder system 69. The upper cylinder space 77 of the piston-cylinder unit 70 forming piston-cylinder system 69 is separated hermetically from the lower cylinder space 79 by piston 78. Lower cylinder space 79 is always under a constant preset or supporting pressure through a control apparatus 80 and connecting line 81. This supporting pressure may be between 10 and 25 bar and tries to keep piston 78 within the piston-cylinder unit 70 in its upper end position. Operation of the piston-cylinder system 69** can also be reversed, however. As a dynamic pressure in calibration, this pressure may be up to 350 bar and can be made zero in the desire position for the purpose of forming a floating die.

Two piston rods 71 of the piston-cylinder units **67*a*, 67*b*, 67*c*, and 67*d* of the piston-cylinder system 66 have an abutment piece 82 on press frame 63 with an adjustable stop 83 which may consist of a wedge adjustment that can be operated by a variable displacement drive 84. In this way the basic position of abutment pieces 82 on press frame 63, and thus their interaction with the individual piston rods 71 of piston-cylinder units 67*a*, 67*b*, 67*c*, and 67*d***, can be varied safely and with precision within given limits.

When press frame 63 is lowered relative to press platen 62, abutment pieces 82 strike the interchangeably mounted end pieces 100 of piston rods 71 at a time determined by the respective setting and thus necessarily push piston 72 of piston-cylinder units *67a*, *67b*, *67c*, and *67d* downward in the sense of a reduction in volume of the lower cylinder spaces 73. The hydraulic fluid here is consequently displaced in a corresponding amount out of the lower cylinder space 73 through the hydraulic lines 74. The number of hydraulic lines 74 leading over connecting line 76 into the upper cylinder space 77 of piston-cylinder unit 70 of piston-cylinder system 69 is determined by the number (one to four) of the inserted end pieces 100 and by the control apparatus 75. Therefore, the corresponding amount of hydraulic fluid is pressed into the upper cylinder space 77 of the piston-cylinder unit 70, so a shift in piston 78 is forced accordingly, optionally in the downward or upward direction.

If all four hydraulic lines 74 are connected to connecting line 76 by control device 75, then the stroke path taken by piston 78 corresponds exactly to the stroke path taken by piston 72 in piston-cylinder units *67a*, *67b*, *67c* and *67d*. If only the hydraulic lines 74 of three piston-cylinder units *67a*, *67b*, and *67c* are connected to the upper cylinder space 77 by way of control device 75 and connecting line 76, then the ratio of the stroke of piston 78 to the stroke of piston 72 is 0.75:1. If two piston-cylinder units *67a* and *67b* are connected to cylinder space 77 by way of their hydraulic lines 74, control device 75 and connecting line 76, then the ratio of the stroke of piston 78 to the stroke of piston 72 is 0.5:1. If only one piston-cylinder unit *67a* supplies hydraulic fluid through hydraulic line 74, control device 75 and connecting line 76 into the upper cylinder space 77, then a stroke is forced on piston 78 which is only in a ratio of 0.25:1 relative to the stroke of piston 72. In this case, however, the movement of piston 78 of piston-cylinder unit 70 against the constant given or supporting pressure that is always present in the lower cylinder space 79 is induced. The piston-cylinder units *67a* to *67d* may also operate several different piston-cylinder systems simultaneously or piston-cylinder systems 69, 95 and 97 as provided for the additional M press axes, e.g., the $M_2$ to $M_4$ press axes. However, then this operation takes place with a different path ratio.

Press tool 65 has a die 85 which rests in a die platen 86 which is in turn carried by columns 87 which project from a yoke 88. Yoke 88 is in turn secured to a press plunger 89 which is effective as part of piston 78 of piston-cylinder unit 70 of piston-cylinder system 69 as shown readily from FIG. 2.

Columns 87 pass through a carrier plate 90 clamped securely in the housing or frame 68 with the lower plunger 91 of press die 65 resting in a stationary position on it. This press function takes into account a widespread production process.

Upper plunger 92 of press tool 65 is suspended on a carrying plate 93 which is secured to the press frame 63, and serves to guide the movement of the die platen 86 by receiving guide columns 94 secured to the die platen 86, as shown in FIG. 1.

The relative movement of the upper plunger 92 to the lower plunger 91 of press tool 65 is determined by the given stroke of press frame 63 relative to press platen 62, while the parallel relative movement of the die platen 86 and die 85 is controlled by piston-cylinder system 69 or piston-cylinder unit 70. The adjusting movement of piston-cylinder system 69 or piston-cylinder unit 70 depends directly on the piston-cylinder system 66 or its piston-cylinder units *67a*, *67b*, *67c*, and *67d*, which can in turn be influenced by the movement of press frame 63 relative to press platen 62.

With the hydromechanical press system 61 of the type described above, the piston-cylinder units *67a*, *67b*, *67c*, and *67d* of piston-cylinder system 66, function either directly as the $M_1$ press axis or indirectly, namely together with piston-cylinder unit 70, as $M_2$ press axis, in combination with piston-cylinder unit 95 as $M_3$ press axis and in combination with piston-cylinder unit 97 as $M_4$ press axis. They are or can be linked in movement with the main press plunger (the so-called X press axis) in such a way that they can induce a forced control of another press axis, the so-called M press axis, of the hydromechanical press system 61 with different selectable transmission ratios. Since the hydraulic medium does not begin to act on the M press axis until the abutment pieces 82 strike the ends of piston rods 71 and the end pieces 100 inserted there, this time can be varied by the adjustable stops 83 and the respective variable displacement motor within certain given limits. The respective transmission ratio can be varied between 0.25:1 and 1:1, based on the piston-cylinder unit 70 of the $M_2$ press axis by stages with the help of the control device 75 even during the press process.

For the sake of thoroughness, it is also pointed out that hydraulic press part 64 can be equipped as needed with different M press axes and also with additional auxiliary axis. Fundamentally, however, the hydraulic press part 64 should contain all the devices for forming the $M_1$ and $M_2$ press axes, i.e., at least piston-cylinder system 66 and piston-cylinder system 69. Piston-cylinder units 95 and 97 for the $M_3$ and $M_4$ press axes, or for other M press axes, can be added on as subsequent equipment if necessary.

For example, the $M_3$ press axis is installed into press plunger 89 in the form of a piston-cylinder unit 95 according to the drawings. The piston-cylinder unit 97 which is provided as $M_4$ press axis can be accommodated in support plate 93 according to FIG. 1 in such a way that its piston 98 acts by way of piston rod 99 on upper plunger 92 of press die 65.

Of course, hydraulic press part 64 of the type described above may also be equipped with a Y press axis and a Z press axis. Finally, it is also conceivable to design or remodel the hydraulic press part 64 in the acting area of the piston-cylinder system 66 in such a way that its piston-cylinder units *67a*, *67b*, *67c*, and *67d* can be made to act on support plate 90 in case of need if this is desirable. In such case, their lower cylinder spaces 73 would then have to be uncoupled from hydraulic lines 74 and piston-cylinder system 69 by means of suitable cutoff measures.

Then in the latter case, press plunger 89 can be actuated by purely mechanical means or by a cam of the mechanical press part whose movement is derived from the toggle drive, for example, which actuates a lever 96 that can act on the lower end of press plunger 89.

Lever 96, according to FIG. 1 of the drawings, can be used to induce the retraction movement of the die 85 downward by a purely mechanical means after conclusion of each individual pressing operation, namely, against the given or supporting pressure of cylinder space 79. To do so, lever 96 must be moved only by means of a correspondingly shaped cam coupled to the mechanical press drive.

What is claimed is:

1. An auxiliary hydraulic subpress for molding dimensionally stable articles from powdered material, said subpress being constructed as a module adapted to be installed in, and to be driven by the ram of, a pre-existing host press, and comprising a frame adapted to be mounted upon the platen of the host press, such frame supporting an upwardly directed lower die plunger;

an opposing movable frame member adapted to be secured to the ram of the host press and having thereon a downwardly directed upper die plunger in co-axial opposition to said upwardly directed lower die plunger;

a hydraulic ram within said first-mentioned frame supporting a molding die for movement relative to and co-axially of said opposing die plungers;

a hydraulic drive carried by said frame and driven by the movement of the ram of the host press and connected hydraulically to drive said hydraulic ram; and means to vary the transmission ratio between the movement of the ram of the host press and the resulting movement of the hydraulic ram.

2. A subpress according to claim 1 wherein said transmission ratio is variable between 1:1 and 1:0.25 in uniform increments.

3. A subpress according to claim 5 wherein a separate source provides a constant back pressure against the actuation of said at least one piston-cylinder unit of the hydraulic ram by said drive cylinders.

4. A subpress according to claim 3 wherein the plurality of piston-cylinder units also includes two auxiliary piston-cylinder units in addition to said equal displacement unit, and the actuation of each of the units of the ram is powered by said hydraulic drive cylinders.

5. A subpress according to claim 1 wherein the hydraulic drive for the hydraulic ram comprises four identical drive cylinders hydraulically connected to the hydraulic ram and whose pistons are normally disposed to be driven by the ram of the host press, the hydraulic ram comprises a plurality of piston-cylinder units at least one of which has a displacement volume equal to the combined displacement volumes of the four drive cylinders, and wherein the piston-cylinder units of the hydraulic ram can be actuated and controlled individually and collectively.

6. A subpress according to claim 5 wherein said four identical drive cylinders are themselves driven by engagement thereof by the ram of the host press, and wherein the engagement of each such piston by the host press ram is selectively preventable to cause the host press ram to bypass said piston, thereby to vary the transmission ratio between the movement of the host press ram and that of said hydraulic ram in uniform increments from 1:1 to 1:0.25.

7. A subpress according to claim 5 wherein the disposition of each drive cylinder piston with respect to the host press ram may be selectively adjusted to vary the stroke of such piston relative to that of the ram of the host press.

8. A subpress according to claim 7 wherein the adjustability of the disposition of each drive cylinder piston with respect to the host press ram is provided by a wedge actuated by a variable displacement drive.

* * * * *